US009310718B2

(12) United States Patent
Shimizu et al.

(10) Patent No.: US 9,310,718 B2
(45) Date of Patent: Apr. 12, 2016

(54) DEVELOPMENT DEVICE AND IMAGE FORMING APPARATUS INCLUDING THE SAME

(71) Applicant: KYOCERA DOCUMENT SOLUTIONS INC., Osaka (JP)

(72) Inventors: Tamotsu Shimizu, Osaka (JP); Shizuka Okada, Osaka (JP); Takefumi Yotsutsuji, Osaka (JP); Akifumi Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 20 days.

(21) Appl. No.: 14/084,416

(22) Filed: Nov. 19, 2013

(65) Prior Publication Data

US 2014/0140733 A1 May 22, 2014

(30) Foreign Application Priority Data

Nov. 22, 2012 (JP) ..... 2012-256076

(51) Int. Cl.
*G03G 15/08* (2006.01)

(52) U.S. Cl.
CPC ..... *G03G 15/0877* (2013.01); *G03G 15/0893* (2013.01)

(58) Field of Classification Search
CPC ..... G03G 15/0893; G03G 15/0914
USPC ..... 399/254, 256, 267, 272
See application file for complete search history.

(56) References Cited

U.S. PATENT DOCUMENTS 5,124,752 A * 6/1992 Kanno et al. ..... 399/53
2002/0012551 A1* 1/2002 Tsutsui et al. ..... 399/252

(Continued)

FOREIGN PATENT DOCUMENTS

JP 2003-215925 A 7/2003
JP 2004-163559 A 10/2004

(Continued)

OTHER PUBLICATIONS

An Office Action; "Notice of Reasons for Rejection," issued by the Japanese Patent Office on Nov. 25, 2014, which corresponds to Japanese Patent Application No. 2012-256076 and is related to U.S. Appl. No. 14/084,416.

(Continued)

*Primary Examiner* — David Gray
*Assistant Examiner* — Thomas Giampaolo, II
(74) *Attorney, Agent, or Firm* — Studebaker & Brackett PC

(57) ABSTRACT

In a development device, a developer carrier arranged in a housing containing a one-component developer has a circumferential surface carrying the developer. A developer conveying path includes one conveying path along the developer carrier in a first direction and another conveying path in a second direction opposite to the first direction. The developer is circulated and conveyed between the conveying paths. A developer conveying member is arranged in the one conveying path and rotationally driven to convey the developer along the first direction and to supply the developer to the developer carrier. A layer thickness adjusting member is arranged at a distance from the circumferential surface to adjust a layer thickness of the developer supplied to the developer carrier. The developer carrier has a circumferential speed Vd and the developer conveying member has a circumferential speed Vs so that a circumferential speed ratio Vd/Vs satisfies a relationship represented by $1.3 \leq Vd/Vs \leq 5.0$.

4 Claims, 6 Drawing Sheets

(56) References Cited

U.S. PATENT DOCUMENTS

| | | | | |
|---|---|---|---|---|
| 2004/0265014 | A1* | 12/2004 | Takeuchi et al. | 399/274 |
| 2006/0035162 | A1* | 2/2006 | Sugimoto | B82Y 15/00 430/106.1 |
| 2012/0219327 | A1* | 8/2012 | Mihara et al. | 399/254 |
| 2012/0263502 | A1* | 10/2012 | Nakaue et al. | 399/254 |

FOREIGN PATENT DOCUMENTS

| | | | |
|---|---|---|---|
| JP | 2004-317973 | A | 11/2004 |
| JP | 2005-010558 | A | 1/2005 |
| JP | 2009-258216 | A | 11/2009 |
| JP | 2009-300755 | A | 12/2009 |
| JP | 2011-209464 | A | 10/2011 |

OTHER PUBLICATIONS

An Office Action; "Notice of Reasons for Rejection," issued by the Japanese Patent Office on Mar. 3, 2015, which corresponds to Japanese Patent Application No. 2012-256076 and is related to U.S. Appl. No. 14/084,416.

* cited by examiner

DEVELOPMENT DEVICE AND IMAGE FORMING APPARATUS INCLUDING THE SAME

INCORPORATION BY REFERENCE

This application is based on and claims the benefit of priority from Japanese Patent application No. 2012-256076 filed on Nov. 22, 2012, the entire contents of which are incorporated herein by reference.

BACKGROUND

The present disclosure relates to a development device configured to develop an electrostatic latent image formed on an image carrier by using a one-component developer and to an image forming apparatus including the development device.

As a development device used in an image forming apparatus, such as printer, and configured to develop an electrostatic latent image formed on an image carrier by using magnetic one-component developer, a development device having a technique as mentioned below is known. Such a development device includes a developer carrier including a fixed magnet, a layer thickness adjusting member configured to adjust the thickness of a developer layer formed on the developer carrier, and a developer conveying member configured to supply the developer to the developer carrier.

According to the above-mentioned technique, the circumferential speed of the developer carrier is set to be higher than five times the circumferential speed of the developer conveying member in a position where the developer carrier and the developer conveying member faces to each other.

As the above-mentioned technique, in a case where the circumferential speed of the developer carrier is set to be higher than five times the circumferential speed of the developer conveying member, in other words, when the circumferential speed of the developer conveying member is set to be less than ⅕ of the circumferential speed of the developer carrier, the stress subjected to the developer is decreased. In this case, however, the supply of developer from the developer conveying member to the developer carrier was occasionally deficient.

In particular, in a case where the developer conveying member has a screw shape having a helical blade arranged around a rotation shaft, the supply amount of the developer is large in the helical blade portion and the supply amount of the developer is deficient in the rotation shaft portion. As a result, a partial difference in the amount of the developer occasionally often may occurs on the back side of the layer adjusting member, thereby causing a difference in density in the shape of a longitudinal streak on the image.

On the other hand, when the circumferential speed of the developer conveying member is significantly increased to supply a lot of the developer from the developer conveying member to the developer carrier, many developer is retained on the back side of the layer adjusting member. In this case, a problem arose in that deterioration of the developer is accelerated and the driving torque of the development device increases.

SUMMARY

In accordance with an embodiment of the present disclosure, a development device includes a housing, a developer carrier, a developer conveying path, a developer conveying member and a layer thickness adjusting member. The housing contains a one-component developer. The developer carrier is arranged in the housing and configured to be rotationally driven and to have a circumferential surface carrying the developer. The developer conveying path includes one conveying path through which the developer is conveyed along the developer carrier in a first direction in the housing and another conveying path arranged along the one conveying path through which the developer is conveyed in a second direction opposite to the first direction, wherein the developer is circulated and conveyed between the one conveying path and the other conveying path. The developer conveying member is arranged in the one conveying path and rotationally driven to convey the developer along the first direction and to supply the developer to the developer carrier. The layer thickness adjusting member is arranged at a distance from the circumferential surface of the developer carrier and configured to adjust a layer thickness of the developer supplied to the developer carrier. In addition, the developer carrier has a circumferential speed Vd and the developer conveying member has a circumferential speed Vs so that a circumferential speed ratio Vd/Vs satisfies a relationship represented by $1.3 \leq Vd/Vs \leq 5.0$.

In accordance with another embodiment of the present disclosure, an image forming apparatus includes a development device, an image carrier and a transferring device. The development device includes a housing, a developer carrier, a developer conveying path, a developer conveying member and a layer thickness adjusting member. The housing contains a one-component developer. The developer carrier is arranged in the housing and configured to be rotationally driven and to have a circumferential surface carrying the developer. The developer conveying path includes one conveying path through which the developer is conveyed along developer carrier in a first direction in the housing and another conveying path arranged along the one conveying path and through which the developer is conveyed in a second direction opposite to the first direction, wherein the developer is circulated and conveyed between the one conveying path and the other conveying path. The developer conveying member is arranged in the one conveying path and rotationally driven to convey the developer along the first direction and to supply the developer to the developer carrier. The layer thickness adjusting member is arranged at a distance from the circumferential surface of the developer carrier and configured to adjust a layer thickness of the developer supplied to the developer carrier. In addition, the developer carrier has a circumferential speed Vd and the developer conveying member has a circumferential speed Vs so that a circumferential speed ratio Vd/Vs satisfies a relationship represented by $1.3 \leq Vd/Vs \leq 5.0$. The image carrier has a surface on which an electrostatic latent image is formed, to which the developer is supplied from the developer carrier. The transferring device is configured to transfer an image onto a sheet from the image carrier.

The above and other objects, features, and advantages of the present invention will become more apparent from the following description when taken in conjunction with the accompanying drawings in which a preferred embodiment of the present invention is shown by way of illustrative example.

DETAILED DESCRIPTION

Figure 1:
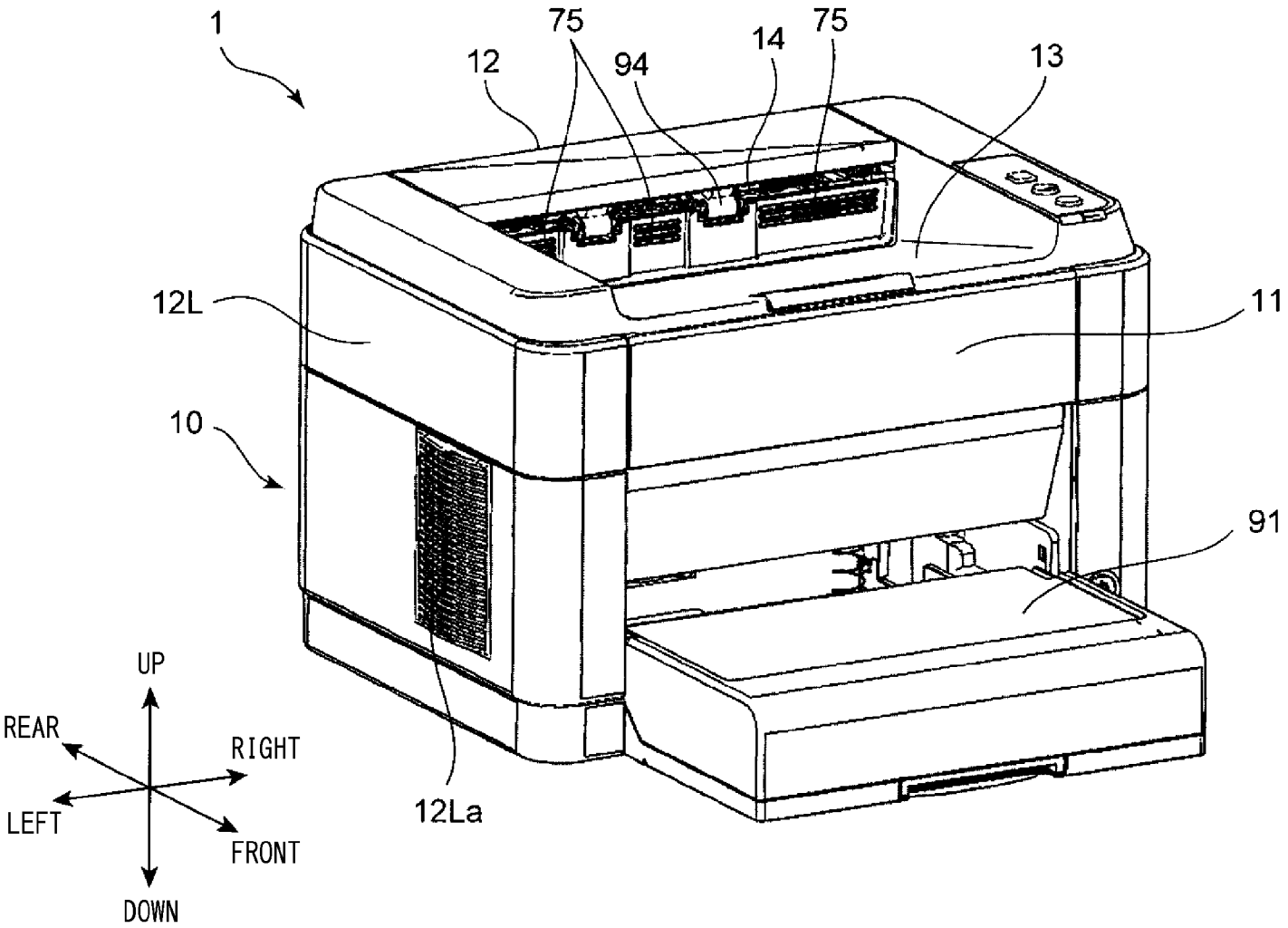
FIG. 1 is a perspective view showing an exterior of an image forming apparatus according to an embodiment of the present disclosure.
Figure 2:
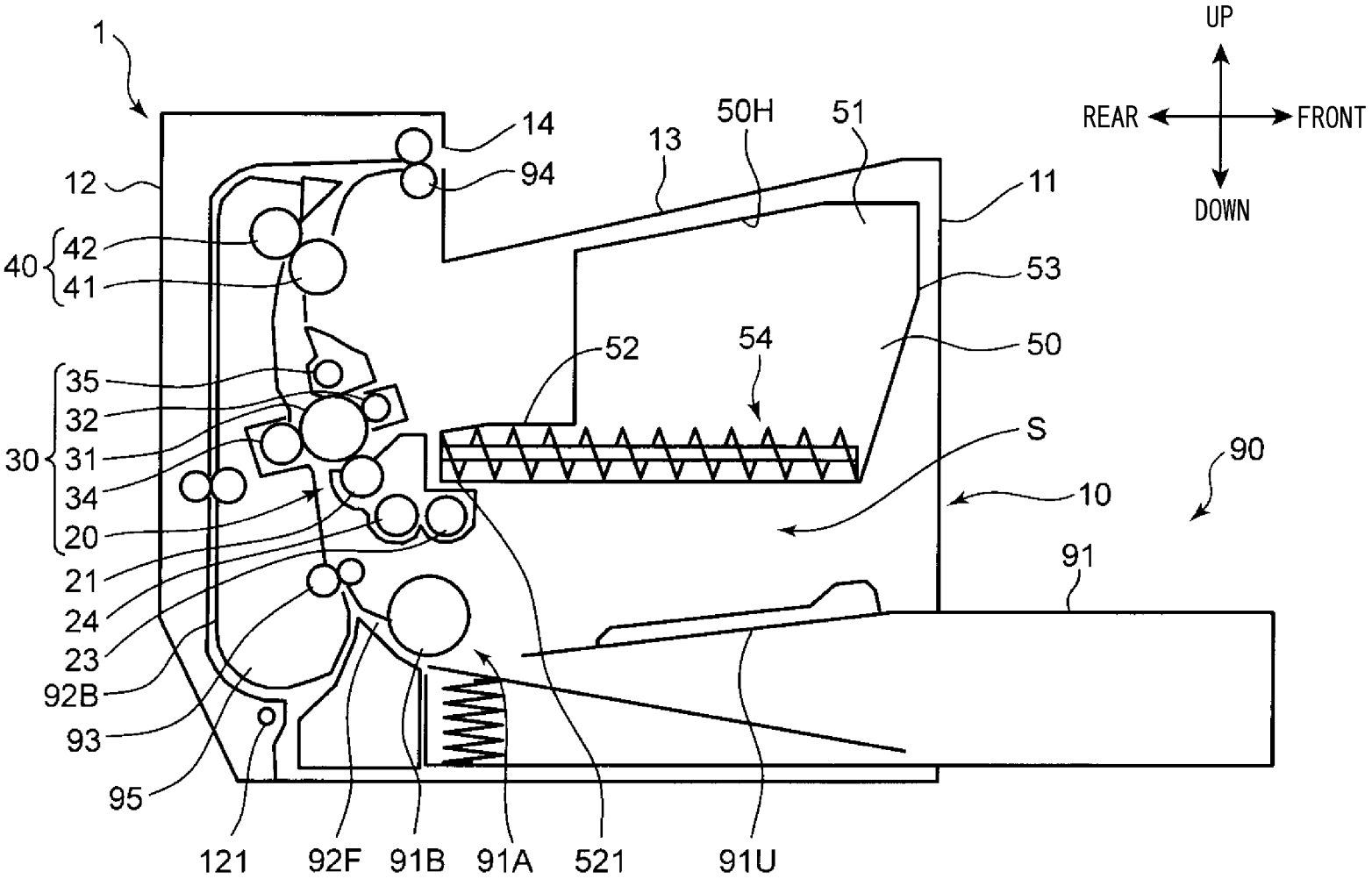
FIG. 2 is a sectional view showing an interior structure of the image forming apparatus according to the embodiment of the present disclosure.

Hereinafter, an embodiment of the present disclosure will be described in detail with reference to the drawings. FIG. 1 is a perspective view showing an exterior of an image forming apparatus 1 according to the embodiment of the present disclosure. FIG. 2 is a side sectional view showing an interior structure of the image forming apparatus 1 according to the embodiment of the present disclosure. While a monochrome printer is illustrated herein as the image forming apparatus 1, the image forming apparatus may be any one of a copier, a facsimile device, and a multifunction peripheral having such functions, or may be another image forming apparatus configured to form color images.

The image forming apparatus 1 includes a main body housing 10 having a housing structure with a substantially rectangular parallelepiped shape and an image forming part 30, a fixing part 40, a toner container 50, and a sheet feeding part 90 that are housed in the main body housing 10.

At a front face side of the main body housing 10, a front cover 11 is provided and, at a rear face side of the main body housing 10, a rear cover 12 is provided. When the front cover 11 is opened, the toner container 50 is exposed to the front face side. This enables a user to take out the toner container 50 from the front face side of the main body housing 10 when a toner (a developer) runs out. The rear cover 12 is a cover that is opened in an event of a sheet jam, maintenance, or the like. The respective image forming part 30 and fixing part 40 can be taken out from the rear face side of the main body housing 10 by opening the rear cover 12. In addition, in side faces of the main body housing 10, a left cover 12L (FIG. 1) and a right cover (not shown in FIG. 1) being opposite to the left cover 12L are individually arranged to extend along the vertical direction. In a front part of the left cover 12L, an intake port 12La configured to take air into the main body housing 10 is arranged. Further, in an upper face of the main body housing 10, a sheet ejecting unit 13 to which an image-formed sheet is ejected is provided. Various components configured to perform image-forming are housed in an inner space S (FIG. 2) defined by the front cover 11, rear cover 12, left cover 12L, right cover and sheet ejecting unit 13.

The image forming part 30 performs an image forming process to form a toner image on a sheet fed from the sheet feeding part 90. The image forming part 30 includes a photosensitive drum 31 (image carrier) and a charging device 32, an exposing device (not shown in FIG. 2), a development device 33, a transfer roller 34 (transferring device), and a cleaning device 35 that are arranged around the photosensitive drum 31. The image forming part 30 is arranged between the left cover 12L and right cover.

The photosensitive drum 31 includes a rotation shaft and a cylindrical face rotating about the rotation shaft. An electrostatic latent image is formed on the cylindrical face, and a toner image according to the electrostatic latent image is carried on the cylindrical face. A photosensitive drum using an amorphous silicon (a-Si) based material may be used as the photosensitive drum 31.

The charging device 32 is configured to uniformly charge the surface of the photosensitive drum 31 and includes a charging roller coming into contact with the photosensitive drum 31.

The cleaning device 35 includes a cleaning blade, cleans the toner adhered to the circumferential face of the photosensitive drum 31 after transfer of the toner image, and conveys the toner to a collection device.

Figure 3:
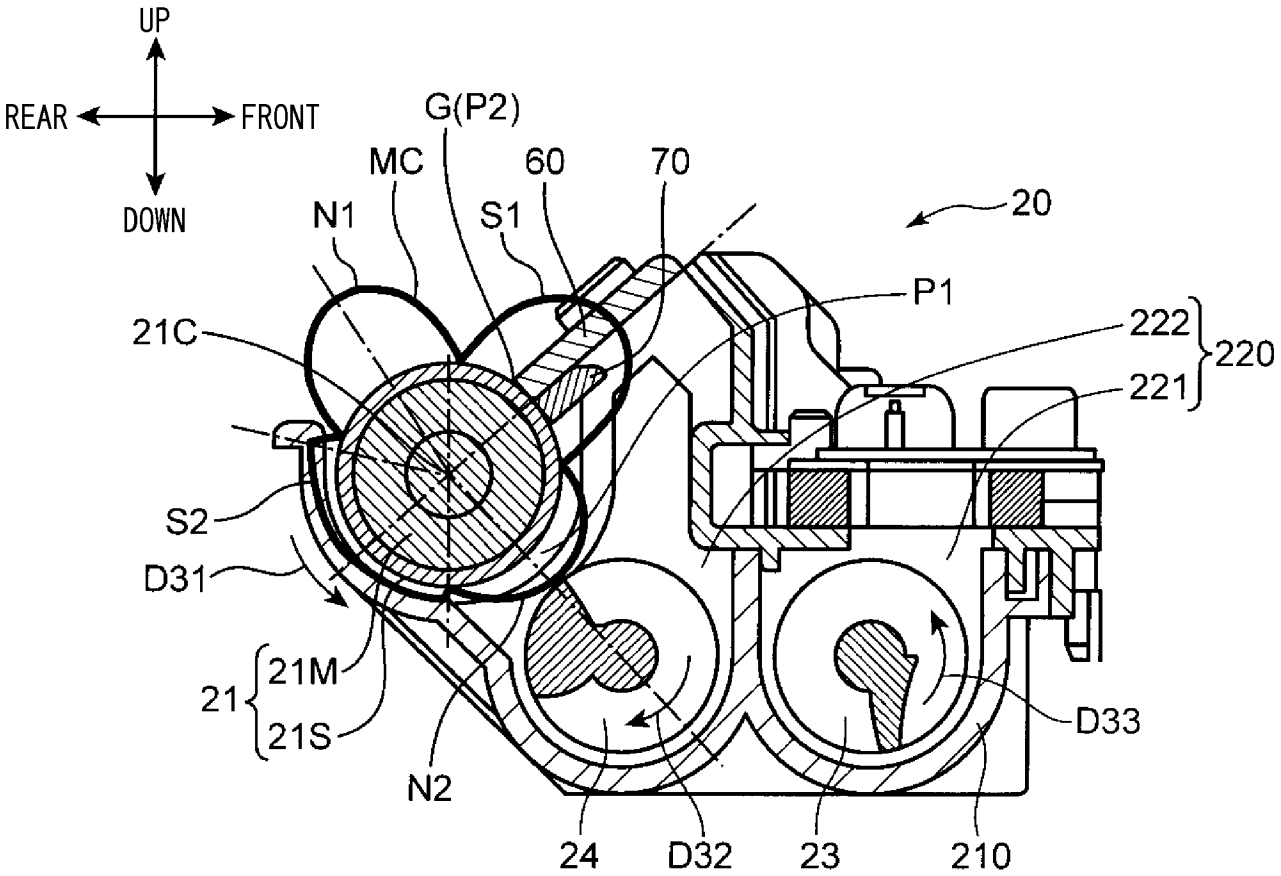
FIG. 3 is a sectional view of a development device according to the embodiment of the present disclosure.

The exposure device includes optical devices, such as a laser light source, mirrors, and lenses, and forms an electrostatic latent image by emitting light modulated in accordance with image data provided from an external apparatus, such as a personal computer, to the circumferential face of the photosensitive drum 31. The development device 20 supplies the toner to the circumferential face of the photosensitive drum 31 in order to develop the electrostatic latent image on the photosensitive drum 31 and to form a toner image. The development device 20 includes a developing roller 21 carrying the toner supplied to the photosensitive drum 31 and a first conveying screw 24 and a second conveying screw 23 that are configured to circulate and convey the developer while agitating the developer in a development housing 210 (FIG. 3). The development device 20 according to the embodiment will be described in detail below.

The transfer roller 34 is a roller configured to transfer the toner image, that is formed on the circumferential face of the photosensitive drum 31, onto a sheet. The transfer roller 34 comes into contact with the cylindrical face of the photosensitive drum 31, thereby forming a transfer nip part. To the transfer roller 34A, transfer bias having a polarity opposite to the toner is applied.

The fixing part 40 performs a fixing process fixing a transferred toner image onto the sheet. The fixing part 40 includes a fixing roller 41 having a heat source provided inside and a pressure roller 42 pressed in contact with the fixing roller 41 to form a fixing nip part with the fixing roller 41. When the sheet having the transferred toner image is passed through the fixing nip part, the toner image is heated by the fixing roller 41 and pressed by the pressure roller 42, and then, the image is fixed onto the sheet.

The toner container 50 stores the toner supplied to the development device 20. The toner container 50 includes a container main body 51 serving as a main toner storage section, a cylindrical part 52 projecting from a lower part of one side face of the container main body 51, a covering member 53 covering another side face of the container main body 51 and a rotating member 54 housed in the container and configured to convey the toner. When the cylindrical part 52 is rotationally driven, the toner stored in the toner container 50 is thereby supplied into the development device 20 through a toner discharge port 521 provided on a lower face of a top end of the cylindrical part 52. A container top plate 50H covering an upper side of the toner container 50 is located below the sheet ejecting unit 13 (see FIG. 2).

The sheet feeding part 90 includes a sheet feeding cartridge 91 configured to store the sheets to which the image forming process is applied (FIG. 2). The sheet feeding cartridge 91 has a part projecting further forward from the front face of the main body housing 10. In the sheet feeding cartridge 91, an upper face of a part housed in the main body housing 10 is covered by a feeding cartridge top plate 91U. The sheet feeding cartridge 91 includes a sheet storage space storing a stack of the sheets, a lift plate lifting up the stack of sheets to feed the sheet and others. In an upper part of a rear end side of the sheet feeding cartridge 91, a sheet pickup part 91A is provided. In the sheet pickup part 91A, a sheet feeding roller 91B is arranged to feed an uppermost sheet of the sheet stack one by one from the sheet feeding cartridge 91.

In the main body housing 10 to convey the sheet, a main conveying path 92F and a reverse conveying path 92B are provided. The main conveying path 92F extends from the sheet pickup part 91A of the sheet feeding part 90 via the image forming part 30 and fixing part 40 to a sheet ejecting port 14 provided facing to the sheet ejecting unit 13 in the upper face of the main body housing 10. The reverse conveying path 92B is a conveying path configured to return a single-side printed sheet to an upstream side from the image forming part 30 in the main conveying path 92F when duplex printing is performed on the sheet.

The main conveying path 92F extends to pass through the transfer nip part formed with the photosensitive drum 31 and transfer roller 34 from a downward side to an upward side. In addition, a registration roller pair 93 is arranged at an upstream side from the transfer nip part in the main conveying path 92F. The sheet is temporarily stopped at the registration roller pair 93 and, after skew correction is made, the sheet is fed to the transfer nip part at a predetermined timing for image transfer. Several conveying rollers configured to convey the sheet are arranged at suitable positions of the main conveying path 92F and reverse conveying path 92B. For example, in the vicinity of the sheet ejecting port 14, a sheet ejecting roller pair 94 is arranged.

The reverse conveying path 92B is formed between an outside face of a reversing unit 95 and an inside face of the rear cover 12 of the main body housing 10. In an inside face of the reversing unit 95, the transfer roller 34 and one roller of the registration roller pair 93 are mounted. The rear cover 12 and reversing unit 95 individually are turnable about a shaft of a supporting pivot 121 provided on lower ends thereof. If a sheet jam occurs in the reverse conveying path 92B, the rear cover 12 is opened. If a sheet jam occurs in the main conveying path 92F, or if a unit including the photosensitive drum or the development device 20 is taken out to the outside, the reversing unit 95 also is opened in addition to the rear cover 12.

Figure 4:
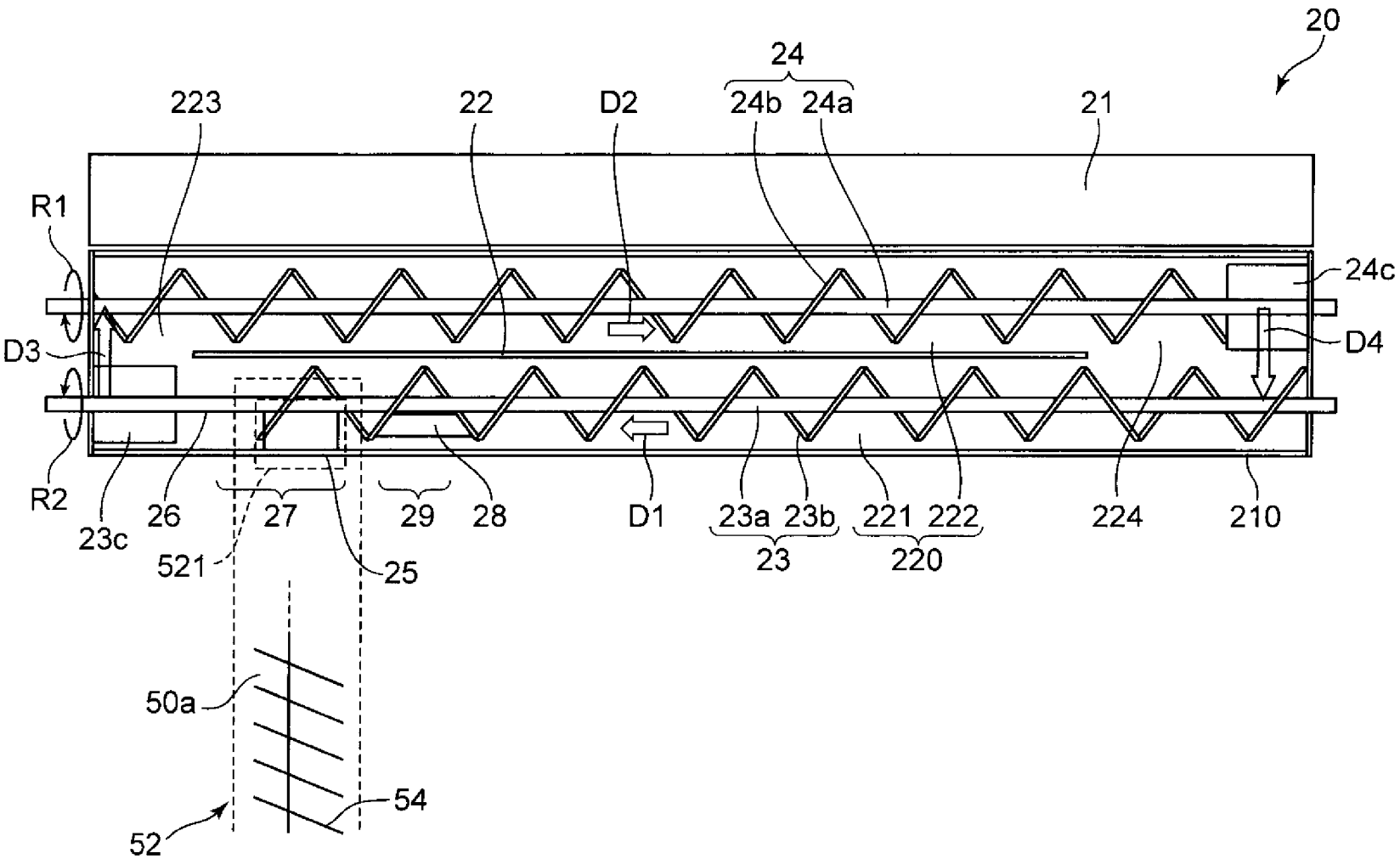
FIG. 4 is a plan view of a development device according to the embodiment of the present disclosure.

Next, the development device 20 according to the present embodiment will now be described in detail. FIG. 3 is a sectional view showing an interior structure of the development device 20. FIG. 4 is a plan view showing the interior structure of the development device 20. The development device 20 includes the development housing 210 (a housing) having an elongated box-liked shape along one direction (an axial direction of the developing roller 21). The development housing 210 includes an inner space 220. In the inner space 220, there are arranged the developing roller 21 (a developer carrier), a first agitating screw 23 (another developer conveying member) a second agitating screw 24 (a developer conveying member) and a toner replenishment port 25. In the present embodiment, as a one-component developing system, in the inner space 220 the toner containing a magnetic material is filled as the developer (a magnetic developer). The toner is agitated and conveyed in the inner space 220 and consecutively supplied from the developing roller 21 to the photosensitive drum 31 in order to develop the electrostatic latent image.

The developing roller 21 includes a cylindrical shape extending along a longitudinal direction of the development housing 210. The developing roller 21 includes a cylindrical-shaped sleeve 21S rotationally driven and a round columnar-shaped magnet 21M fixedly arranged along the axial direction in the sleeve 21S. The sleeve 21S is rotationally driven in a direction indicated by an arrow D31 shown in FIG. 3 by a driving means (not shown), thereby carrying the magnetic toner on the circumferential face. The magnet 21M is a fixed magnet having several magnetic poles along a circumferential direction of the sleeve 21S in the sleeve 21S. The magnet 21M has four magnetic poles, namely, an S1 pole, an N1 pole, an S2 pole and an N2 pole arranged along the circumferential direction. In FIG. 3, a curved line MC surrounding the developing roller 21 represents a radial magnetic force of the developing roller 21 which is brought about by the individual magnetic poles as a distribution of in the circumferential direction on the sleeve 21S. The S1 pole is arranged at a front upper position in the magnet 21M. The S1 pole is used as an adjusting pole in order to adjust a toner layer. The N1 pole is arranged at a rear upper position in the magnet 21M. The N1 pole has a function of supplying the toner to the photosensitive drum 31 as a developing pole. The N2 pole is arranged at a front lower position in the magnet 21M. N2 pole serves as a magnetic catch pole and has a function of scooping up the toner to the developing roller 21. The S2 pole is arranged at a position in the magnet 21M at a downstream side from the N1 pole in a rotation direction of the sleeve 21S and at an upstream side from the N2 pole in the rotation direction of the sleeve 21S. The S2 pole is arranged mainly at a rear lower position in the magnet 21M. The S2 pole has a function as a conveying pole collecting the toner not moved to the side of the photosensitive drum 31 at the N1 pole into the development housing 210. The toner carried on the sleeve 21S is conveyed to an opening arranged in the development housing 210 and is supplied to a photosensitive drum 31 arranged on the facing side.

The inner space 220 of the development housing 210 is covered by a top plate and partitioned into a first conveying path 221 (another conveying path) and a second conveying path 222 (one conveying path) elongated in left and right directions by a partition plate 22 extending along the left and right directions. The partition plate 22 has the width shorter than the development housing 210 in the left and right directions and, in a left end and a right end of the partition plate 22, a first communication route 223 and a second communication route 224 respectively allowing communication between the first conveying path 221 and the second conveying path 222 are provided. According to this, in the development housing 210, a circulation path (a developer conveying path) running through the first conveying path 221, first communication route 223, second conveying path 222 and second communication route 224 is formed. The toner is conveyed clockwise in the circulation path in FIG. 4.

The toner replenishment port 25 is an opening bored in the top plate and arranged above the vicinity of the left end of the first conveying path 221 (FIG. 4). The toner replenishment port 25 is arranged facing to the circulation path and has a function of receiving replenishing toner replenished from the toner container 50 and intruding it into the inner space 220. In the present embodiment, the toner replenishment port 25 is formed of an opening with dimensions of a 14 mm×8 mm in a plan view, for example.

The first agitating screw 23 is arranged in the first conveying path 221. The first agitating screw 23 includes a first rotation shaft 23*a* and a first helical blade 23*b* spirally projecting on the periphery of the first rotation shaft 23*a*. The first agitating screw 23 is rotationally driven by a driving means (not shown) about the first rotation shaft 23*a* (an arrow D33 in FIG. 3, an arrow R2 in FIG. 4), thereby conveying the toner in a direction indicated by an arrow D1 in FIG. 4 (an arrow D1 direction). The first agitating screw 23 conveys the developer so as to pass a position facing to the toner replenishment port 25 in the first conveying path 221. Thus, the first agitating screw 23 has a function mixing new toner flowing in from the toner replenishment port 25 with other toner conveyed through the first conveying path 221 and delivering the mixed toner to the second conveying path 222's side. In the present embodiment, the outside diameter of the first helical blade 23*b* is 14 mm and a pitch in the axial direction is set to 20 mm, for example. While the pitch is changeable in proportion to the conveying performance of the first agitating screw 23, it is preferable to determine the pitch to 15 mm as a lower limit to maintain the toner conveying ability. In a downstream side of the first agitating screw 23 in the toner conveying direction (the arrow D1 direction), a first paddle 23*c* is arranged. The first paddle 23*c* is a plate-like member arranged on the first rotation shaft 23*a*.

The first paddle 23*c* is rotated together with the first rotation shaft 23*a* to deliver the toner from the first conveying path 221 to the second conveying path 222 in a direction indicated by an arrow D3 shown in FIG. 4. In the present embodiment, the axial length of the first paddle 23*c* is set to 20 mm, for example.

The second agitating screw 24 is arranged in the second conveying path 222. The second agitating screw 24 includes a second rotation shaft 24*a* (a rotation shaft) and a second helical blade 24*b* (a screw blade) spirally projecting on the periphery of the second rotation shaft 24*a*. The second agitating screw 24 is rotationally driven by a driving means (not shown) about the second rotation shaft 24*a* (an arrow D32 in FIG. 3, an arrow R1 in FIG. 4), thereby conveying the toner in a direction of indicated by an arrow D2 in FIG. 4 (an arrow D2 direction). The second agitating screw 24 conveys and supplies the toner to the developing roller 21 in the second conveying path 222. In the present embodiment, the outside diameter of the second helical blade 24*b* is 14 mm and the pitch in the axial direction is set to 20 mm, for example. While the pitch is changeable in proportion to the conveying performance of the second agitating screw 24, it is preferable to determine the pitch to 15 mm as a lower limit to maintain the toner conveying ability.

The second agitating screw 24 is arranged at a front upper position of the developing roller 21. More specifically, the second agitating screw 24 is arranged facing to the N2 pole of the magnet 21M. In conjunction with the rotation of the second agitating screw 24 (the arrow D32 in FIG. 3), the tonner is supplied from the second agitating screw 24 to the sleeve 21S. The second rotation shaft 24*a* of the second agitating screw 24 is located below the rotation shaft of the sleeve 21S. In addition, the rotation shaft 24*a* of the second agitating screw 24 is located below the lower end part of the circumferential face of the sleeve 21S. In the present embodiment, the supply path of toner to the developing roller 21 is formed by the path supplying the toner from the second agitating screw 24. The second agitating screw 24 supplies the toner to the sleeve 21S by scooping up from a downward side to an upward side for the developing roller 21.

in a downstream side from the second agitating screw 24 in the toner conveying direction (the arrow D2 direction), a second paddle 24*c* is arranged. The second paddle 24*c* is a plate-like member arranged on the second rotation shaft 24*a*. The second paddle 24*c* is rotated together with the second rotation shaft 24*a*, and delivers the toner from the second conveying path 222 to the first conveying path 221 in a direction indicated by an arrow D4 shown in FIG. 4. In the present embodiment, the axial length of the second paddle 24*c* is set to 20 mm, for example.

The development device 20 further includes a layer adjusting member 60 (a layer thickness adjusting member) and a magnetic plate 70 (a facing magnet).

The layer adjusting member 60 is located at a front upper position of the developing roller 21. The layer adjusting member 60 is arranged along the axial direction of the developing roller 21 so as to face to the circumferential face of the developing roller 21 (the sleeve 21S). More specifically, the layer adjusting member 60 is arranged facing to the S1 pole of the magnet 21M in the developing roller 21. The layer adjusting member 60 is a plate-like member made of a magnetic material. The layer adjusting member 60 has a rectangular shape with longer sides extending toward the developing roller 21 in a cross section perpendicular to the rotation shaft of the developing roller 21. A top end part of the layer adjusting member 60 is located at a distance from the sleeve 21S of the developing roller 21. As a result, between the top end part and sleeve 21S, a layer adjusting gap G is formed. The layer adjusting member 60 adjusts the layer thickness of the toner scooped up onto the sleeve 21S from the second agitating screw 24.

The magnet plate 70 is arranged along the layer adjusting member 60 at a front side of the layer adjusting member 60. In other words, the magnet plate 70 is arranged at an upstream side from the layer adjusting member 60 in the rotation direction of the sleeve 21S of the developing roller 21 (an arrow D31 in FIG. 3). In the present embodiment, the magnetic plate 70 is composed of a permanent magnet having a plate-like shape. The magnet plate 70 has a substantially rectangular shape extending along the layer adjusting member 60 in a cross section perpendicular to the rotation shaft of the developing roller 21. The magnet plate 70 is fixed to a lower part of the layer adjusting member 60. The magnet plate 70 has a magnetic force of an S pole having the same polarity as the S1 pole at a position facing to the S1 pole of the magnet 21M. In addition, the magnet plate 70 has an N pole at a position more distant than the S pole to the S1 pole of the magnet 21M.

Thus, in the present embodiment, the magnet plate 70 is located at an upstream side from the layer adjusting member 60 in the rotation direction of the developing roller 21 (the sleeve 21S). In other words, from the upstream side toward the downstream side in the rotation direction of the developing roller 21, the magnet plate 70 and the layer adjusting member 60 are arranged in order so as to face to the circumferential face of the developing roller 21.

Thus, in the present embodiment, the second agitating screw 24 supplies the toner to the sleeve 21S toward a first position P1 facing to a downward side of the circumferential face of the sleeve 21S. In addition, the layer adjusting member 60 adjusts the thickness of the toner on the sleeve 21S in a second position P2 facing to an upward side of the circumferential face of the sleeve 21S being located above the first position P1. At this time, because the S1 pole of the magnet 21M and the S pole of the magnetic plate 70 have magnetic forces of the same polarity, a repulsive magnetic field acts between the sleeve 21S and magnetic plate 70. The repulsion magnetic field is classified into a magnetic field propagating toward the upstream side in the rotation direction of the sleeve 21S and a magnetic field propagating toward the downstream side (the layer adjusting member 60's side) in the rotation direction of the sleeve 21S. As a result, to the toner conveyed on the sleeve 21S and entered into the lower part of the magnetic plate 70, a force for moving to the circumferential face of the sleeve 21S is applied. Consequently, toner layer adjustment is implemented in a state where the toner is formed into a thin layer. In addition, the toner having not been entered into the layer adjusting gap G of the layer adjusting member 60 is promoted by the repulsive magnetic field to flow toward an upstream side in the rotation direction of the sleeve 21S.

Referring to FIG. 4, the toner container 50 mentioned above is located above the toner replenishment port 25 of the development housing 210. The toner container 50 includes a toner conveying path 50*a* through which the toner is conveyed inside, the rotating member 54 and the toner discharge port 521. The toner container 50 is assembled with the development device 20 so that a longitudinal direction of the toner container 50 (the direction along which the toner container 50 is formed) is positioned in a direction perpendicular to the longitudinal direction of the development device 20 (the developer conveying direction of the first agitating screw 23, the arrow D1 direction).

The toner discharge port 521 is arranged at a bottom part of the toner container 50 to correspond to the toner replenishment port 25 of the development device 20. The rotating member 54 includes a shaft part and a blade part rotating about the shaft part (see FIG. 2), and conveys the replenishing toner in the toner conveying path 50*a* toward the toner discharge port 521. The toner dropped from the toner container 50 is replenished to the development device 20 via the toner replenishment port 25.

Figure 5:
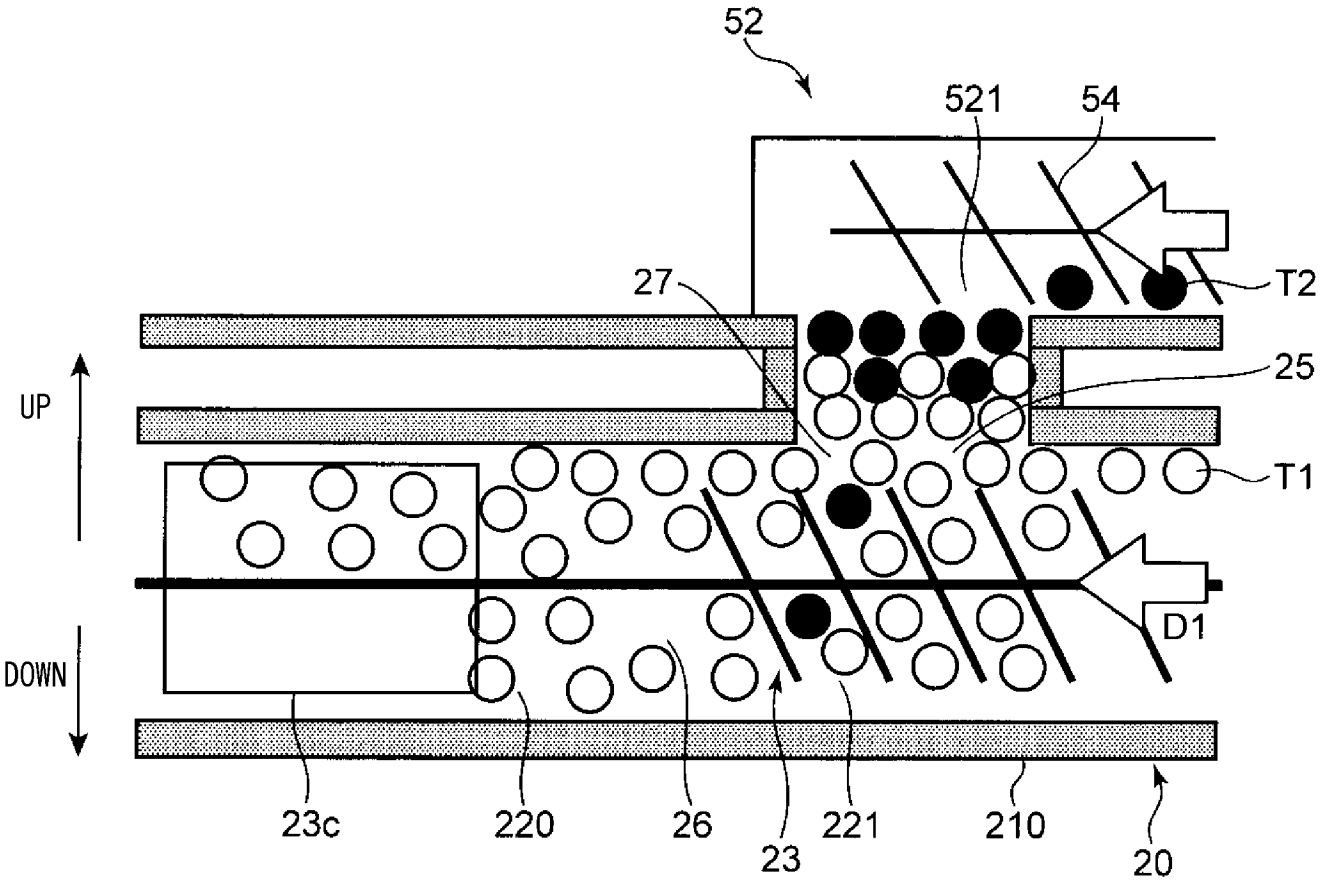
FIG. 5 is a schematic view showing the development device, in a situation in which a toner is replenished, according to the embodiment of the present disclosure.
Figure 6:
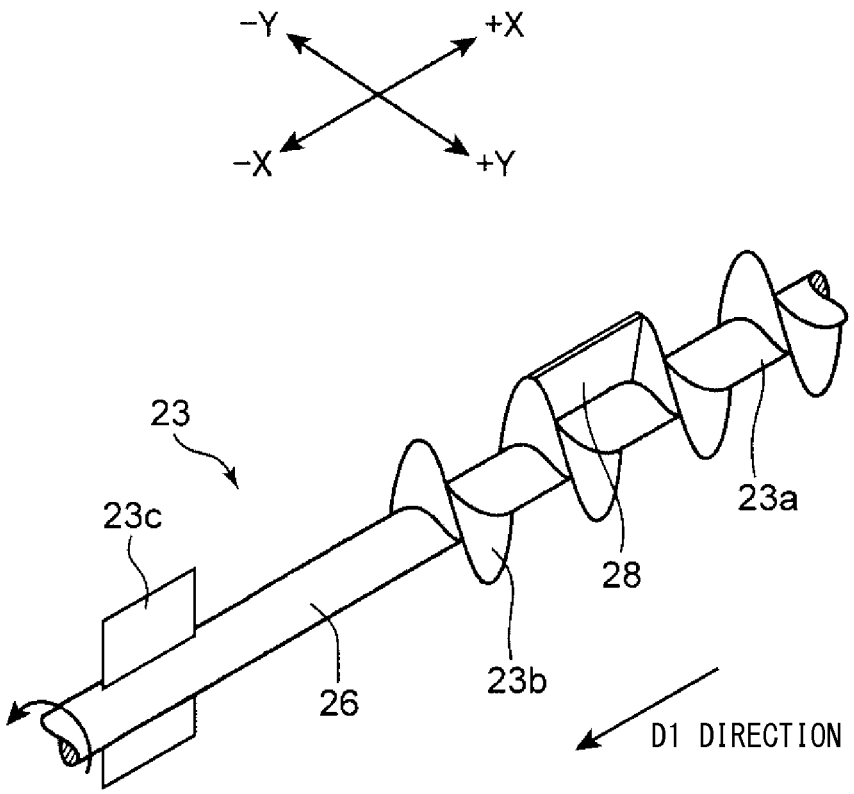
FIG. 6 is an enlarged perspective view of a first agitating screw of the development device according to the embodiment of the present disclosure.

Next, the flow of the toner newly replenished for replenishment from the toner replenishment port 25 to the development housing 210 will be described. FIG. 5 is sectional view showing the toner replenishment port 25 arranged to the development device 20 and the vicinity of the toner discharge port 521 arranged in the toner container 50. Note that, in FIG. 5, the arrangement of the toner container 50 is shown by being rotated 90 degrees in the horizontal direction for explanation. Actually, the rotating member 54 in the toner container 50 is configured to extend to the front side (a viewer side) with respect to the drawing paper and the first agitating screw 23 and the rotating member 54 in the toner container 50 have a positional relationship perpendicular to each other. FIG. 6 is a partially enlarged perspective view of the first agitating screw 23.

Replenishing toner T2 supplied from a toner discharge port 521 of the toner container 50 drops into the first conveying path 221, and is mixed with existing toner T1 and conveyed by the first agitating screw 23 along the arrow D1 direction. At this time, the toners T1 and T2 are agitated and charged.

The first agitating screw 23 includes a conveyance capacity suppressing part 26 arranged at a downstream side from the toner replenishment port 25 in the toner conveying direction and configured to partially suppress developer conveyance capacity. In the present embodiment, the conveyance capacity suppressing part 26 is formed by omitting the first helical blade 23*b* of the first agitating screw 23 (see FIG. 6). More specifically, the first agitating screw 23 includes the first helical blade 23*b* extending from the upstream side to the toner replenishment port 25 in the toner conveyance direction D1. In the present embodiment, the axial length of the conveyance capacity suppressing part 26 is set to 12 mm, for example. In other words, the conveyance capacity suppressing part 26 is correspondent to the portion where the first rotation shaft 23*a* is partially arranged. In this case, the conveyance capacity suppressing part 26 does not have the developer conveying performance in the axial direction of the first rotation shaft 23*a*. Therefore, in the first conveying path 221, the toner conveyed from the upstream side of the conveyance capacity suppressing part 26 begins to be retained in the conveyance capacity suppressing part 26 in the conveyance capacity suppressing part 26. The retained toner is progressively accumulated to a position at an immediately upstream side of the conveyance capacity suppressing part 26 and in which the toner replenishment port 25 faces to the first conveying path 221. As a result, a retention part 27 of the developer is formed in the vicinity of the inlet port of the retention part 27.

When the replenishing toner T2 is supplied from the toner replenishment port 25 and the amount of the toner in the inner space 220 increases, the toner retained in the retention part 27 blocks (or closes) the toner replenishment port 25, thereby suppressing any further toner supply. Thereafter, when the toner in the inner space 220 is consumed from the developing roller 21, and then, the toner retained in the retention part 27 decreases, the toner having blocked the toner replenishment port 25 decreases. Thereby, spacing between the retention part 27 and toner replenishment port 25 occurs. As a result, the replenishing toner T2 flows in again from the toner replenishment port 25 to the inner space 220. Thus, the present embodiment adopts a volume-replenishment type toner replenishment manner in which the reception amount of the replenishing toner is adjusted corresponding to the decrease in the amount of the toner retained in the retention part 27.

In a development device using one-component developer, agitation of different particles (toner and carrier) as carried out in a case using a two-component developer is not needed. According to this, a conveying member (hereafter, called as a "third agitating screw") excepted for the present disclosure corresponding to the second agitating screw 24 was rotated at a lowest possible peripheral speed in order to reduce the stress subjected to the toner. In particular, the circumferential speed of the developing roller 21 was often set to be higher than five times the circumferential speed of the third agitating screw. In other words, the stress subjected to the developer was reduced by setting the circumferential speed of the third agitating screw to be less than ⅕ of the circumferential speed of the developing roller 21. In this case, however, the supply of the developer from the third agitating screw to the developing roller 21 was occasionally deficient.

In particular, similarly to the second agitating screw 24, in the case that the third agitating screw has a screw shape having the helical blade arranged about the rotation shaft, the supply amount of the developer is large in the helical blade portion and the supply amount of the developer is deficient in the rotation shaft portion. As a result, a partial difference in the amount of the developer occasionally may occurs on the back side of the layer adjusting member 60, thereby causing a difference in density in the shape of a longitudinal streak on the image. In addition, in the case where, as in the present embodiment, the magnetic plate 70 is arranged at the upstream side of the layer adjusting member 60, due to the magnetic force of the magnetic plate 70, the developer in the periphery cannot be moved, and accordingly, the difference in the amount of the developer becomes further significant.

On the other hand, when the circumferential speed of the third agitating screw may be significantly increased to supply a lot of the developer from the third agitating screw to the developing roller 21, many developer is retained on the back side of the layer adjusting member 60. In such a case, a problem may arise in that deterioration of the developer is accelerated and the driving torque of the development device 20 increases.

In the present embodiment, in order to solve the problem mentioned above, the ratio between a circumferential speed Vd of the developing roller 21 and a circumferential speed Vs of the second agitating screw 24 is suitably determined. In particular, in the present embodiment, the circumferential speed Vd of the developer carrier and the circumferential speed Vs of the developer conveying member are determined so that the ratio between the circumferential speeds satisfies a relationship represented by $1.3 \leq Vd/Vs \leq 5.0$. As a result, a sufficient amount of the toner is supplied from the second agitating screw 24 to the developing roller 21, thereby suppressing the occurrence of nonuniformity in the amount of the developer adjusted by the layer adjusting member 60. In addition, because an excessive amount of the toner is supplied to the developing roller 21 from the second agitating screw 24, it is suppressed that the toner is overloaded in the periphery of the layer adjusting member 60 to the extent of accelerating the deterioration of the toner.

Next, the present embodiment will be described on the basis of examples, but note that the embodiment is not limited to the examples. The examples described herebelow were each conducted under the following experimental conditions:

Photosensitive drum 31: OPC drum;

Circumferential speed of photosensitive drum 31: 146 mm/sec;

Layer adjusting gap G: 0.3 mm;

Developing bias AC component: rectangular wave amplitude of 1.7 kV, duty of 50%;

Developing bias DC component: 270 V;

Surface potential of photosensitive drum 31 (background part/image part): 430 V/30 V;

Diameter of developing roller 21: 16 mm

Diameter of photosensitive drum 31: 24 mm; and

Average particle size of magnetic toner: 6.8 μm (D50).

Table 1 shows evaluation a result of Experiment 1 regarding the circumferential speed ratio Vd/Vs between the circumferential speed Vd of the developing roller 21 and the circumferential speed Vs of the second agitating screw 24.

ing the transition of the density on an image sample. In the line of the image density deterioration in Table 1, the single-circle mark represents a state where no density deterioration occurred, and the cross mark represents a state where density deterioration occurred. The image density deterioration was evaluated in a case where the images each having the image density of 1% on the sheet are printed multiple times one by one (1% 1-sheet intermittence) and in a case where the similar images are printed multiple times in units of 3 sheets (1% 3-sheet intermittence). In addition, the evaluation was conducted also in a case where the images each having the image density of 3.8% are printed multiple times in units of 3 sheets (3.8% 3-sheet intermittence). A practical use condition is correspondent to the "3.8% 3-sheet intermittence" condition, and the "1% 1-sheet intermittence" condition is correspondent to a stress condition exceeding the practical use condition.

As shown in Table 1, when the circumferential speed ratio Vd/Vs is within the range of 1.3≤Vd/Vs≤5.0, the longitudinal streak level and the image density deterioration were led to excellent results. More specifically, in the above-mentioned range, the longitudinal streak level became the triangle mark's level or more, and no image density deterioration occurred under the "3.8% 3-sheet intermittence" condition being the practical use condition, and the "1% 3-sheet intermittence" condition.

TABLE 1

| | | | | | | | | | | | | | | | |
|---|---|---|---|---|---|---|---|---|---|---|---|---|---|---|---|
| Developing roller | Diameter | mm | 16.0 | 16.0 | 16.0 | 16.0 | 16.0 | 16.0 | 16.0 | 16.0 | 16.0 | 16.0 | 16.0 | 16.0 | 16.0 |
| | Rotation speed | rpm | 245.6 | 245.6 | 245.6 | 245.6 | 245.6 | 245.6 | 245.6 | 245.6 | 245.6 | 245.6 | 245.6 | 245.6 | 245.6 |
| | Circumferential speed | mm/s | 205.6 | 205.6 | 205.6 | 205.6 | 205.6 | 205.6 | 205.6 | 205.6 | 205.6 | 205.6 | 205.6 | 205.6 | 205.6 |
| Second agitating screw | Diameter | mm | 14.0 | 14.0 | 14.0 | 14.0 | 14.0 | 14.0 | 14.0 | 14.0 | 14.0 | 14.0 | 14.0 | 14.0 | 14.0 |
| | Rotation speed | rpm | 51.7 | 56.4 | 61.1 | 65.8 | 70.5 | 86.7 | 94.0 | 107.5 | 112.8 | 141.0 | 197.4 | 235.0 | 250.0 |
| | Circumferential speed | mm/s | 37.9 | 41.3 | 44.8 | 48.2 | 51.7 | 63.5 | 68.9 | 78.8 | 82.6 | 103.3 | 144.6 | 172.2 | 183.2 |
| Circumferential speed ratio (Vd/Vs) of Developing roller/second agitating screw | | | 5.4 | 5.0 | 4.6 | 4.3 | 4.0 | 3.2 | 3.0 | 2.6 | 2.5 | 2.0 | 1.4 | 1.2 | 1.1 |
| Longitudinal streak level | | | X | Δ | Δ | Δ | ○ | ○ | ◎ | ◎ | ◎ | ◎ | ◎ | ◎ | ◎ |
| Image density deterioration | B/W 1% 1-sheet intermittence | | ○ | ○ | ○ | ○ | ○ | ○ | ○ | ○ | ○ | X | X | X | X |
| | B/W 1% 3-sheet intermittence | | ○ | ○ | ○ | ○ | ○ | ○ | ○ | ○ | ○ | ○ | ○ | X | X |
| | B/W 3.8% 3-sheet intermittence | | ○ | ○ | ○ | ○ | ○ | ○ | ○ | ○ | ○ | ○ | ○ | ○ | ○ |

In Experiment 1, with adjustment of the circumferential speed Vs of the second agitating screw 24, the circumferential speed ratio Vd/Vs was varied, and the longitudinal streak level and the image density deterioration under each condition were evaluated. The longitudinal streak level was evaluated in a halftone image formed on the sheet. In the line of the longitudinal streak level in Table 1, a double-circle mark represents a state where no longitudinal streak occurred. A single-circle mark represents a state where almost no longitudinal streak occurred, and a triangle mark represents a state of quite unquestionable in the practical use while some very minor longitudinal streaks occurred. A cross mark represents a state where the longitudinal streaks occurred.

In addition, the image density deterioration depends upon the decrease in electrostatic property in accordance with the deterioration of the developer and was evaluated by measur- In addition, when the circumferential speed ratio is within the range of 2.0<Vd/Vs, no image density deterioration occurred even under the "1% 1-sheet intermittence" condition being the stress condition, and then, stable image quality was maintained. Further, when the circumferential speed ratio is within the range of Vd/Vs≤4.0, the longitudinal streak level became the single-circle mark's level or more, and then, as the halftone image, an image without nonuniformity was obtained.

Table 2 shows a result of Experiment 2 where the diameter and circumferential speed Vd of the developing roller 21 were varied in comparison to Experiment 1. Evaluation of the longitudinal streak level and the image density deterioration was carried out in the same way as described above.

TABLE 2

| | | | | | | | | | | |
|---|---|---|---|---|---|---|---|---|---|---|
| Developing roller | Diameter | mm | 16.0 | 18.0 | 16.0 | 16.0 | 16.0 | 18.0 | 16.0 | 16.0 |
| | Rotation speed | rpm | 184.2 | 184.2 | 184.2 | 184.2 | 148.7 | 148.7 | 148.7 | 148.7 |
| | Circumferential speed | mm/s | 154.2 | 173.5 | 154.2 | 154.2 | 124.5 | 140.0 | 124.5 | 124.5 |
| Second agitating screw | Diameter | mm | 14.0 | 16.0 | 14.0 | 14.0 | 14.0 | 16.0 | 14.0 | 14.0 |
| | Rotation speed | rpm | 38.8 | 52.9 | 70.5 | 176.3 | 34.1 | 39.8 | 68.3 | 119.5 |
| | Circumferential speed | mm/s | 28.4 | 44.3 | 51.7 | 129.1 | 25.0 | 33.4 | 50.0 | 87.6 |
| Circumferential speed ratio (Vd/Vs) of Developing roller/second agitating screw | | | 5.4 | 3.9 | 3.0 | 1.2 | 5.0 | 4.2 | 2.5 | 1.4 |

TABLE 2-continued

| | | | | | | | | | |
|---|---|---|---|---|---|---|---|---|---|
| Longitudinal streak level | | X | ○ | ◎ | ◎ | Δ | Δ | ◎ | ◎ |
| Image density deterioration | B/W 1% 1-sheet intermittence | ○ | ○ | ○ | X | ○ | ○ | ○ | X |
| | B/W 1% 3-sheet intermittence | ○ | ○ | ○ | X | ○ | ○ | ○ | ○ |
| | B/W 3.8% 3-sheet intermittence | ○ | ○ | ○ | ○ | ○ | ○ | ○ | ○ |

As shown in Table 2, even in a case where the diameter and the circumferential speed Vd of the developing roller 21 is different from those in Experiment 1, when the circumferential speed ratio Vd/Vs is within the range of 1.3≤Vd/Vs≤5.0, the longitudinal streak level and the image density deterioration became excellent results. More specifically, in the above-mentioned range, the longitudinal streak level became the triangle mark's level or more, and no image density deterioration occurred under every conditions including the "3.8% 3-sheet intermittence" condition being the practical use condition.

Thus, according to the embodiment described above, the second agitating screw 24 conveys the tonner in a first direction in the second conveying path 222 and supplies the toner to the developing roller 21. In addition, the circumferential speed Vd of the developing roller 21 and the circumferential speed Vs of the second agitating screw 24 are determined so that the circumferential speed ratio satisfies the relationship represented by 1.3≤Vd/Vs≤5.0. According to this, the toner is sufficiently supplied from the second agitating screw 24 to the developing roller 21, thereby suppressing the occurrence of nonuniformity in the amount of the toner adjusted by the layer adjusting member 60. Moreover, because an excessive amount of the toner is supplied to the developing roller 21 from the second agitating screw 24, it is suppressed that the toner is overloaded in the periphery of the layer adjusting member 60 to the extent of accelerating the deterioration of the toner.

Further, according to the embodiment described above, the circumferential speed ratio satisfies the relationship represented by 2.0<Vd/Vs, thereby further suppressing the overloading occurred in the toner in the periphery of the layer adjusting member 60. Further, since the circumferential speed ratio satisfies the relationship represented by Vd/Vs≤4.0, a sufficient amount of the toner is stably supplied to the developing roller from the second agitating screw 24, thereby further suppressing the occurrence of nonuniformity in the amount of the developer adjusted by the layer adjusting member 60.

Further, according to the present embodiment, the second agitating screw 24 supplies the developer to the developing roller 21 while being rotated from the downward side to the upward side in the region facing to the developing roller 21. According to this, relative to a two-component developer, the one-component developer in no need of the agitation of the different particles relative to a two-component developer can be more stably supplied from the second agitating screw 24 to the developing roller 21.

Further, according to present embodiment described above, even when the force exerted to supply the toner from the second agitating screw 24 to the developing roller 21 is partially varies while depending on the pitch of the helical blade of the second agitating screw 24, the circumferential speed Vd of the developing roller 21 and the circumferential speed Vs of the second agitating screw 24 are determined so that the circumferential speed ratio satisfies the relationship represented by 1.3≤Vd/Vs≤5.0, whereby a sufficient amount of the developer is supplied from the second agitating screw 24 to the developing roller 21.

Further, according to the present embodiment, even when the toner on the developing roller 21 is difficultly moved in the axial direction (the direction intersecting with the rotation direction) of the developing roller 21 by the magnetic plate 70 arranged at the upstream side of the layer adjusting member 60, a sufficient amount of the developer is supplied from the second agitating screw 24 to the developing roller 21. Therefore, the occurrence of nonuniformity in the amount of the toner adjusted by the layer adjusting member 60 is suppressed.

Further, according to the image forming apparatus 1 including the development device 20 of the embodiment described above, occurrence of longitudinal-streak liked image quality defects in the image formed on the sheet are suppressed. Further, stable images are formed on the sheets for a long term.

Although the development device 20 and the image forming apparatus 1 using the same have been described as above, the present disclosure is not limited thereto, modified embodiments such as described below may be adopted, for example.

In the above-mentioned embodiment, a situation in which the toner replenishment from the toner container 50 to the development device 20 was adjusted by the conveyance capacity suppressing part 26 (the retention part 27) was described. However, the present disclosure is not limited thereto. Another situation may be applied so that the toner is supplied for replenishment from the toner container 50 to the development housing 210 in response to a detection result of, a density sensor (not shown) detecting the image density or a toner sensor (not known) detecting the amount of the toner.

In the development device 20 in which, as described above, the toner is supplied for replenishment from the toner container 50 to the development housing 210 according to the amount of the toner in the retention part 27, the circumferential speed Vd of the developing roller and the circumferential speed Vs of the second agitating screw 24 are determined so that the circumferential speed ratio satisfies the relationship represented by 1.3≤Vd/Vs≤5.0, whereby the amount of the distribution in the axial direction of the toner retained in the back side of the layer adjusting member 60 is stabilized. More specifically, the toner distribution according to the pitch of the second helical blade **24*b* of the second agitating screw 24 is not easily formed on the back side of the layer adjusting member 60. In such case, because the distribution of the toner in the development housing 210 is stabilized, the amount of the toner in the retention part 27 is accurately changed in proportion to the amount of the toner consumed by the developing roller 21. Consequently, the toner can suitably be supplied for replenishment from the toner container 50 to the development housing 210** in proportion to the amount of toner consumption.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus, comprising:

an image carrier having a surface on which an electrostatic latent image is formed;

a development device supplying a one-component magnetic developer to the image carrier;

a transferring device configured to transfer an image onto a sheet from the image carrier; and a developer container including a developer discharge port configured to store the developer supplied to the transferring device, wherein the a development device includes:

a housing configured to contain a one-component the developer;

a developer carrier arranged in the housing and configured to be rotationally driven and to have a circumferential face carrying the developer;

a developer conveying path including, in the housing, one conveying path through which the developer is conveyed along the developer carrier in a first direction and other conveying path arranged along horizontally with the one conveying path through which the developer is conveyed in a second direction opposite to the first direction, wherein the developer is circulated and conveyed between the one conveying path and the other conveying path;

one developer conveying member arranged in the one conveying path at a space from the circumferential face of the developer carrier, configured to have a rotation shaft and a screw blade formed around the rotation shaft and rotationally driven from a downward side to an upward side in a region facing to the developer carrier to convey the developer along the first direction and to supply the developer to the developer carrier;

a layer thickness adjusting member arranged at a distance from the circumferential face of the developer carrier and configured to adjust a layer thickness of the developer supplied to the developer carrier;

a facing magnet arranged at a distance from the circumferential face of the developer carrier on an upstream side of the layer thickness adjusting member in a rotation direction of the developer carrier;

a replenishment port opened in the housing above the other conveying path and at a downstream side in the second direction of the other conveying path to receive the developer supplied from a storage section the developer discharge port of the developer container;

other developer conveying member arranged in the other conveying path and configured to be rotationally driven to convey the developer supplied from the replenishment port in the second direction and to deliver the developer to the one conveying path; and a conveyance capacity suppressing part arranged at a downstream side from the replenishment port in the second direction in the other developer conveying member to partially suppress conveyance capacity of the developer of the other developer conveying member, and then, to form a retention part of the developer at a position in the developer conveying path to which the replenishment port faces, wherein, the rotation shaft of the one developer conveying member is located at a position below a lower end part of the circumferential face of the developer carrier and arranged at a distance from the lower end part in a horizontal direction, the one developer conveying member has an upper end part of its outer circumference edge arranged below the center of the rotation shaft of the developer carrier, the layer thickness adjusting member adjusts the thickness of the toner in a second position being located above a first position when the one developer conveying member supplies the developer to the first position on the circumferential face of the developer carrier, in a case where the amount of the developer in the developer conveying path is increased, the replenishment port is blocked by toner accumulating in the retention part, in another case where the amount of the developer in the developer conveying path is decreased, space is created to allow the developer to flow from the replenishment port to the developer conveying path, and the developer carrier has a circumferential speed Vd and the one developer conveying member has a circumferential speed Vs so that a circumferential speed ratio Vd/Vs satisfies a relationship represented by $1.3 \leq Vd/Vs \leq 5.0$.

2. The image forming apparatus according to claim 1, wherein the circumferential speed Vd of the developer carrier and the circumferential speed Vs of the one developer conveying member are set so that the circumferential speed ratio Vd/Vs satisfies a relationship represented by $2.0 < Vd/Vs \leq 5.0$.

3. The image forming apparatus according to claim 1, wherein the circumferential speed Vd of the developer carrier and the circumferential speed Vs of the one developer conveying member are set so that the circumferential speed ratio Vd/Vs satisfies a relationship represented by $1.3 \leq Vd/Vs \leq 4.0$.

4. The image forming apparatus according to claim 1, wherein the other developer conveying member includes a helical blade extending from an upstream side to the replenishment port in the second direction.

* * * * *